US010109435B1

(12) United States Patent
Wood et al.

(10) Patent No.: US 10,109,435 B1
(45) Date of Patent: Oct. 23, 2018

(54) INTERCHANGEABLE ELECTRICAL ASSEMBLY WITH TACTILE SWITCH AND ILLUMINATION DEVICE

(71) Applicant: GAARVIS, LLC, Klamath Falls, OR (US)

(72) Inventors: Gale M. Wood, Klamath Falls, OR (US); Travis M. Carpenter, Klamath Falls, OR (US)

(73) Assignee: GAARVIS, LLC, Klamath Falls, OR (US)

( * ) Notice: Subject to any disclaimer, the term of this patent is extended or adjusted under 35 U.S.C. 154(b) by 261 days.

(21) Appl. No.: 15/227,434

(22) Filed: Aug. 3, 2016

Related U.S. Application Data

(60) Provisional application No. 62/204,104, filed on Aug. 12, 2015.

(51) Int. Cl.

| | |
|---|---|
| ***H01H 13/62*** | (2006.01) |
| ***F21V 15/01*** | (2006.01) |
| ***F21V 23/02*** | (2006.01) |
| ***F21V 23/04*** | (2006.01) |
| ***H01H 1/025*** | (2006.01) |
| ***H01H 3/12*** | (2006.01) |
| ***H01H 3/38*** | (2006.01) |
| ***H01H 9/02*** | (2006.01) |

(52) U.S. Cl.
CPC ..... *H01H 13/62* (2013.01); *F21V 15/01* (2013.01); *F21V 23/02* (2013.01); *F21V 23/0414* (2013.01); *H01H 1/025* (2013.01); *H01H 3/12* (2013.01); *H01H 3/38* (2013.01); *H01H 9/0214* (2013.01)

(58) Field of Classification Search
None
See application file for complete search history.

(56) References Cited

U.S. PATENT DOCUMENTS

| | | | |
|---|---|---|---|
| 4,286,311 | A | 8/1981 | Maglica |
| 4,739,129 | A | 4/1988 | Owen et al. |
| 4,777,393 | A | 10/1988 | Peot |
| 4,808,862 | A | 2/1989 | Carvalho et al. |
| 4,843,526 | A | 6/1989 | Price, III |
| 5,598,082 | A | 1/1997 | Gilpin et al. |

(Continued)

*Primary Examiner* — Sharon Payne
(74) *Attorney, Agent, or Firm* — Jerry Haynes Law

(57) ABSTRACT

An interchangeable electrical assembly provides a tactile switch that selectively opens and closes a circuit for operating myriad styles of illumination devices. The tactile switch detachably mates with, and regulates conduction of direct current to the illumination device. The tactile switch also provides tactile feedback of an operating position. A wire carries a 12 volt direct current into a switch housing. A conductive member receives the direct current. A cap receives a force to axially displace the conductive member while providing tactile feedback to the position of the conductive member. A contact pin operatively connects to the conductive member. A spring biases the conductive member to disengage from the contact pin. The cap selectively displaces the conductive member to engage the contact pin. An illumination device detachably mates with tactile switch, and includes a conducting shaft, an inverter for converting direct current to alternating current, and circuitry to generate illumination.

20 Claims, 4 Drawing Sheets

(56) References Cited

U.S. PATENT DOCUMENTS

| | | | | |
|---|---|---|---|---|
| 8,497,438 | B2 * | 7/2013 | Chauvet | H01H 1/205<br>200/16 A |
| 2008/0304254 | A1 * | 12/2008 | Canino | F21L 4/04<br>362/183 |

* cited by examiner

INTERCHANGEABLE ELECTRICAL ASSEMBLY WITH TACTILE SWITCH AND ILLUMINATION DEVICE

CROSS REFERENCE OF RELATED APPLICATIONS

This application claims the benefits of U.S. provisional application No. 62/204,104, filed Aug. 12, 2015 and entitled ILLUMINATION DEVICE WITH ADAPTABLE TACTILE SWITCH, which provisional application is incorporated by reference herein in its entirety.

FIELD OF THE INVENTION

The present invention relates generally to an interchangeable electrical assembly with tactile switch and illumination device. More so, the present invention relates to an electrical assembly comprising a tactile switch that is adaptable to interchangeably mate with different illumination devices, wherein the tactile switch selectively regulates conduction of a 12 volt direct current into the illumination device to generate illumination, and provides tactile indication of the operating position of the tactile switch.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, a switching device includes an actuator for positioning a movable member of the device in desired operative relationship with a fixed member of the device. One example is a multi-position electrical switch with a slidable actuator for positioning one or more movable contact members in electrically connecting relationship with respective fixed contact members at various positions along a fixed base of the switch. Consequently, multi-position electrical switches of the prior art have been provided with means for indicating when the actuators thereof are located in desired positions relative to the bases of the switches. These actuator position indicator means of the prior art may, however, be relatively complex and result in a prohibitive increase in the cost of producing the switches.

It is known that one type of switch that provides tactile indication of the position is a tactile switch. A tactile switch is an on/off electronic switch that is only on when the button is pressed or if there is a definitive change in pressure. Another way to consider it, as momentary make or brake switch. As soon as a tactile switches button is released, the circuit is broken.

Generally, high powered spotlights incorporate a large cylindrical housing having a reflector and a high intensity bulb at one end of the housing. The bulb receives power from an external power supply and generates high intensity light. The housing attaches to a large movable support so the operator can control the movement of the spotlight and direct the high intensity beam of light at a particular object. The lack of portability of most spotlights can be problematic when outdoors or portability is needed.

It is recognized that spotlights, and especially hand-held spotlights, are used outdoors or in rural areas. Components of the spotlight, including the power switch and light intensity switch, can be broken or disintegrate in such environments. In these environments, only direct current form a battery or other direct power source, may be available. The outdoor environment may also not allow for great portability of the spotlight. Furthermore, at night, the location and position of the switch is difficult to ascertain. This can be problematic when operating spotlights having multiple intensities of illumination or colors.

Other proposals have involved switches that operate illumination devices. The problem with these switches and devices is that they do not provide tactile feedback about the position of the illumination device, or a capacity to convert direct current to alternating current. Also, the handle used to control the illumination device is not easily accessible. Even though the above cited switches and illumination devices meets some of the needs of the market, an interchangeable electrical assembly with tactile switch and illumination device is still desired.

SUMMARY

Illustrative embodiments of the disclosure are generally directed to an interchangeable electrical assembly with tactile switch and illumination device. The interchangeable electrical assembly provides a tactile switch that serves to selectively open and close a circuit for operating an illumination device, such as a handheld spotlight. The tactile switch is configured to carry a direct current to the illumination device, which may then convert the direct current to an alternating current for operation. The tactile switch is interchangeable and adaptable to detachably mate with myriad styles and sizes of illumination devices. Thus, the assembly provides an interchangeable circuit switch that can be adapted to different illumination devices, and especially handheld spotlights. This interchangeability can be especially useful when the original switch of the illumination device expires.

The tactile switch regulates conduction of a 12 volt direct current to the illumination device. The tactile switch also provides tactile indication of the operating position of the tactile switch. In this manner, a direct current can be fed into the illumination device through a tactile feedback with a switch that is both interchangeable and identifiable through touchable verification.

In one embodiment, the assembly comprises a wire configured to enable carrying of a direct current. The wire may be connected to a power source, such as a battery or power outlet. The assembly further comprises a tactile switch configured to enable selective opening and closing of a circuit. The tactile switch is encased in a switch housing defined by a sidewall and a cavity. The switch housing receives a downstream end of the wire.

A conductive member is disposed in the cavity of the switch housing. The conductive member is configured to conduct the direct current from the wire. The conductive member is further configured for axial displacement in the cavity. This movement is relative to the switch housing. A base carries the conductive member in a generally axial disposition in the cavity of the switch housing.

The tactile switch further comprises a cap that operatively connects to the conductive member. The cap may be resilient, such that a force applied to the cap, such as depressing or flicking, transfers to the conductive member. The force axially displaces the conductive member. When displaced in this manner, the cap provides tactile indication of the axial position of the conductive member relative to the base. A ticking sound or a clicking tactile sensation may provide this indication. The cap may be resilient, so as to enable tactile feedback.

The tactile switch further comprises a contact pin operatively that is connected to the conductive member. The contact pin is in a generally coaxial relationship with the conductive member, so as to selectively conduct the direct current. The contact pin has metallic components, and thus conducts the direct current.

A spring operatively connects to the contact pin and the conductive member. The spring is configured to bias the conductive member to a retracted position that disengages the conductive member from the contact pin. The force applied to the cap axially displaces the conductive member to an extended position that deforms the spring and enables engagement with the contact pin. Further, a spring axis carries the spring in a generally coaxial relationship with the contact pin and the conductive member.

In this manner, engagement between the conductive member and the contact pin enables electrical conduction of the direct current from the conductive member to the contact pin. Conversely, disengagement between the conductive member and the contact pin disables electrical conduction of the direct current from the conductive member to the contact pin.

In some embodiments, the assembly utilizes a second major component to emit an illumination. The tactile switch regulates power and light intensity to the illumination device. The illumination device comprises a casing defined by a casing cavity. The casing is configured to detachably mate with the switch housing of the tactile switch. The mating may be friction fit, magnetic, or through various fasteners.

A conducting shaft is disposed in the casing cavity of the casing. The conducting shaft configured to detachably mate with the contact pin in conjunction with the detachable mating between the casing and the switch housing. Thus, when the switch housing and the casing are mated, the conducting shaft and the contact pin are engaged. The conducting shaft, however, receives the direct current from the contact pin only when the conductive member has been displaced to the extended position to enable engagement with the contact pin.

The illumination device further comprises an inverter that is in operational contact with the conducting shaft for receiving the direct current. The inverter converts the direct current to an alternating current. A circuitry in the illumination device converts the alternating current into illumination.

One objective of the present invention is to provide an adaptable tactile switch that operates with different types of illumination device.

Another objective is to replace any type of switch on a spotlight with the tactile switch before or after switch failure.

Yet another objective is to provide a tactile switch in which the spring enables the conductive member to engage the contact pin in response to an applied force, thereby increasing the reliability of the tactile switch.

Yet another objective is to provide strong tactile feedback of when the conductive member is disposed in either the extended or retracted relational position with the contact pin.

Yet another objective is to provide a switch housing that easily mates with a casing for the illumination device.

Yet another objective is to provide a tactile switch that can handle a 12 volt direct current for selectively feeding a spotlight.

Yet another objective is to provide an inexpensive to manufacture and operate tactile switch and illumination device.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 2A illustrates the tactile switch, and FIG. 2B illustrates the illumination device operatively connected to the tactile switch, in accordance with an embodiment of the present invention;

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

An interchangeable electrical assembly 300 with tactile switch and illumination device is referenced in FIGS. 1-4.

The interchangeable electrical assembly 300, hereafter "assembly 300", provides an interchangeable tactile switch 100 and an illumination device 200. The tactile switch 100 is operable to integrate with multiple types of illumination devices 200. This can be especially useful after an original switch in the illumination device 200 has expired. The tactile switch 100 may be adapted to selectively open and close a circuit for operating the illumination device 200. This adaptively creates an interchangeable switch mechanism that can be adapted to myriad styles and sizes of illumination devices. The tactile switch 100 also provides strong tactile feedback to indicate the position of the switch 100, and thereby when the assembly 300 is powered on or off, or to indicate a setting of the light intensity.

Figure 1:
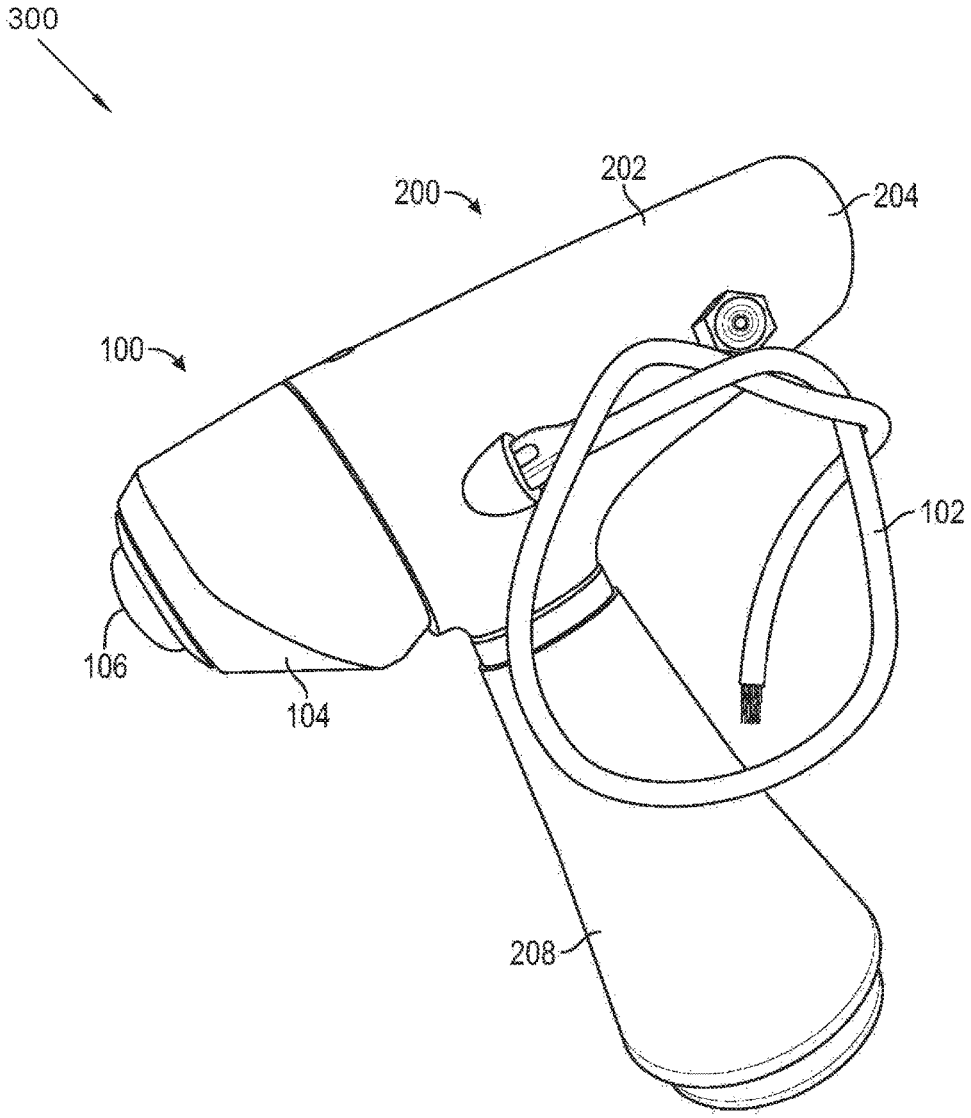
FIG. 1 illustrates a perspective view of an exemplary illumination device operatively connected to an exemplary tactile switch, in accordance with an embodiment of the present invention.

As illustrated in FIG. 1, the tactile switch 100 regulates conduction of a 12 volt direct current to the illumination device 200. The tactile switch 100 also provides tactile indication of the operating position of the tactile switch 100. In this manner, a direct current can be fed into the illumination device 200 through a tactile switch 100 that is both interchangeable and identifiable through touchable verification. The tactile switch 100 enables selective powering on and off, and light intensity of the illumination device 200. The tactile switch 100 also provides a strong tactile feedback to any of a number of selected positions.

Those skilled in the art will recognize that a tactile switch 100 is a type of switch that completes a circuit for powering on an electrical device when a button, tab, switch, or sensor is actuated with a force. As soon as the button is released, the circuit is broken. As used in the present invention, the tactile switch 100 is a manually operated electromechanical device with one or more sets of electrical contacts, which are connected to external circuits and a direct current. Each set of contacts can be in one of two states: either closed: meaning the contacts are touching and electricity can flow between them; or open: meaning the contacts are separated and the switch is nonconductive. The mechanism actuating the transition between these two states (open or closed) may include, without limitation, a tactile switch (FIG. 2A), a flip switch, a resilient button, a spring click, a toggle, and a momentary type.

Figure 2A:
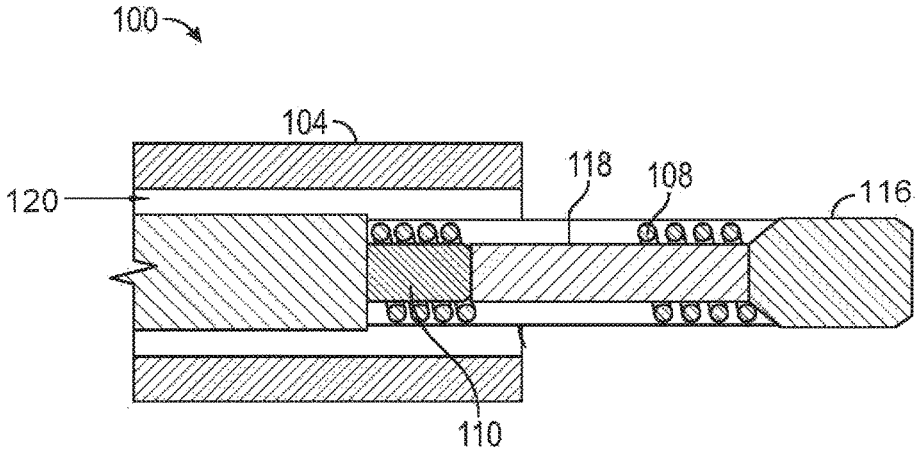
FIGS. 2A and 2B illustrate sectioned side views of the tactile switch and the illumination device, where
Figure 2B:
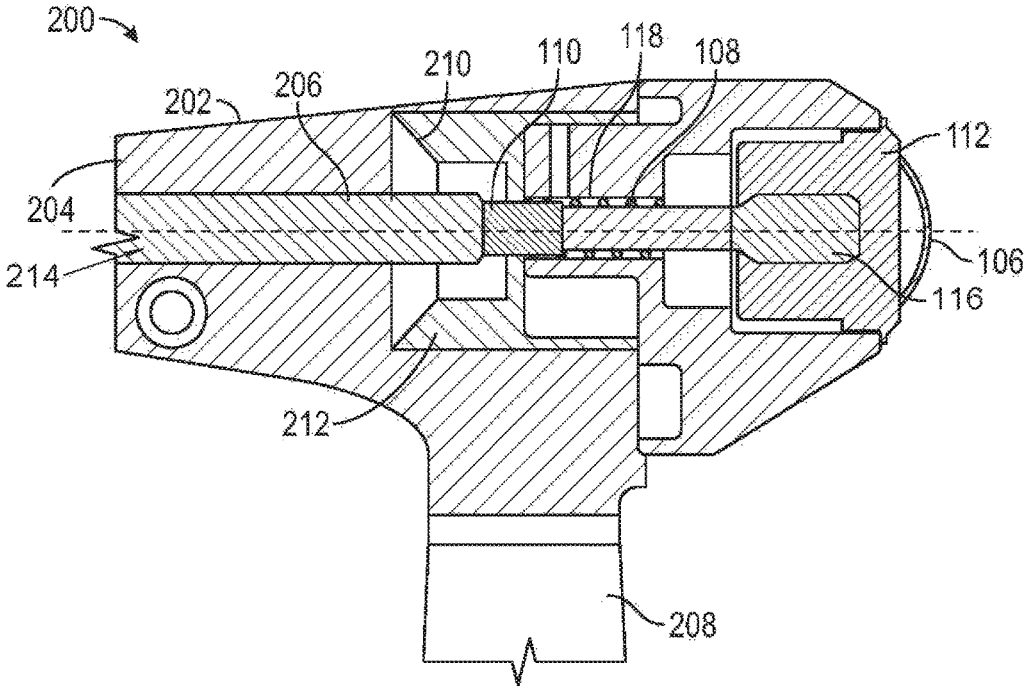

Looking now at an exemplary embodiment of an illumination device 200 shown in FIG. 2B, the illumination device 200 is defined by a protective casing 202. The casing 202 is configured to detachably mate with the switch housing 104 of the tactile switch 100. The illumination device 200 is configured to project an intense light beam from a light outlet 204 in the casing 202. Actuating and extinguishing the light beam requires opening and closing a circuit with the tactile switch 100. The illumination device 200 comprises an inverter 210 for converting the direct current from the tactile switch 100 to an alternating current. A circuitry 212 converts the alternating current to illumination. The illumination device 200 may include, without limitation, a spotlight, a floodlight, and a flashlight. In one alternative embodiment, a handle 208 may be used to manipulate the illumination device 200 and provide a brace for manipulation of the tactile switch 100.

The present invention enables: 1) adaptable attachment of the tactile switch 100 to a variety of illumination devices; 2) facilitated manipulation of the tactile switch 100; 3) tactile feedback from the tactile switch 100 to indicate when the circuit is opened or closed; and 4) an illumination device 200 that converts the direct current from the tactile switch 100 to an operable alternating current to enable illumination. The facilitated manipulation and the tactile indication are especially useful when operating the illumination device 200 in the dark or in inclement weather. The capacity of the illumination device 200 to convert direct current to alternating current is useful when outdoors or relying on a battery power source that generates direct current.

FIG. 1 illustrates the assembly 300, including the components of the illumination device 200 and the interchangeable tactile switch 100 working together. The assembly 300 comprises a wire 102 configured to enable carrying of a direct current. The wire 102 may be defined by an upstream end connected to a power source, such as a battery or power outlet, and a downstream end connected to the tactile switch 100. The wire 102 carries direct current into the tactile switch 100, and subsequently, the illumination device 200.

The direct current carried by the wire 102 may include a 12 volt direct current. Though in other embodiments, larger or smaller voltages may be used. In some embodiments, the wire 102 may include a conductive, single, usually cylindrical, flexible strand or rod of metal. The wire 102 is configured to carry electrical current. The wire 102 may have in solid core, stranded, or braided form. In some embodiments, the wire 102 is a circular in cross-section, square, hexagonal, flattened rectangular, or other cross-sections.

The assembly 300 further comprises a tactile switch 100 configured to enable selective opening and closing of a circuit. The tactile switch 100 is encased in a switch housing 104 defined by a sidewall 114 and a cavity 120. The switch housing 104 receives a downstream end of the wire 102. The switch housing 104 is configured to cover and provide structural support for the tactile switch 100. The wire 102 may pass through an aperture in the switch housing 104 to conduct the direct current into the appropriate components of the tactile switch 100. Suitable materials for the switch housing 104 may include, without limitation, ABS plastic, polyvinyl chloride, polyurethane, and fiberglass.

A conductive member 116 is disposed in the cavity 120 of the switch housing 104. The conductive member 116 is configured to conduct the direct current from the wire 102. The conductive member 116 is further configured for axial displacement in the cavity 120. This movement is relative to the switch housing 104. In some embodiments, various soldering elements and clips may be used to connect the terminus of the wire 102 to the conductive member 116.

Looking again at FIG. 2A, the tactile switch 100 has a base 112. The base 112 carries the conductive member 116 in a generally axial disposition in the cavity 120 of the switch housing 104. The base 112 may include a generally cylindrical core that is sufficiently durable to withstand impact forces and inhibit penetration by moisture.

Figure 3:
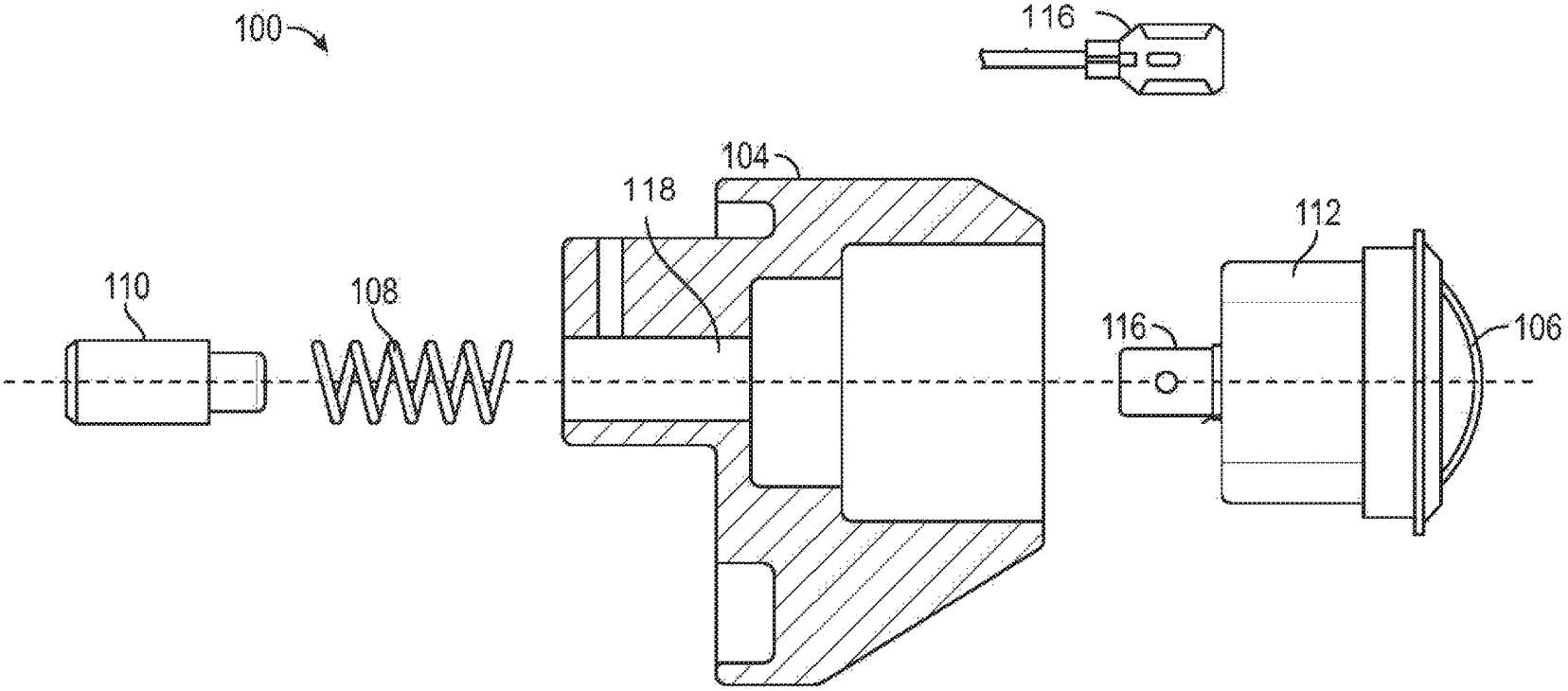
FIG. 3 illustrates a side sectioned view of tactile switch, in accordance with an embodiment of the present invention.

As FIG. 3 illustrates, the tactile switch 100 further comprises a cap 106 that operatively connects to the conductive member 116. The cap 106 may be resilient, such that a force applied to the cap 106, such as depressing or flicking, transfers to the conductive member 116. The force axially displaces the conductive member 116. When displaced in this manner, the cap 106 provides tactile indication of the axial position of the conductive member 116 relative to the base. A ticking sound or a clicking tactile sensation or a bump by the thumb, may provide this indication. The cap may be resilient, so as to enable tactile feedback.

In one possible embodiment, the cap 106 is a resilient rubber cap having a flexible configuration. The flexible characteristics of the resilient rubber cap enhance the tactile indication of the position of the conductive member 116 by allowing a digit to feel the conductive member 116 under the resilient rubber cap. Though in other embodiments, the cap 106 can also include a rigid V-shaped switch, as shown in FIG. 4.

In some embodiments, the tactile switch 100 may also include a contact pin 110 operatively that is connected to the conductive member 116. The contact pin 110 is in a generally coaxial relationship with the conductive member 116, so as to selectively conduct the direct current. The contact pin 110 is displaced through a spring-biased mechanism to engage and disengage the conductive member 116.

The contact pin 110 conducts the direct current from the conductive member 116 when engaged. Though, the contact pin 110 does not conduct direct current when the conductive member 116 is disengaged in the retracted position. In one embodiment, the contact pin 110 is a brass pin, having about a 0.250" diameter. Though any conductive metal may be used to fabricate the contact pin 110. In one embodiment, the contact pin 110 is fabricated from brass, and has a diameter of about 0.250".

Figure 4:
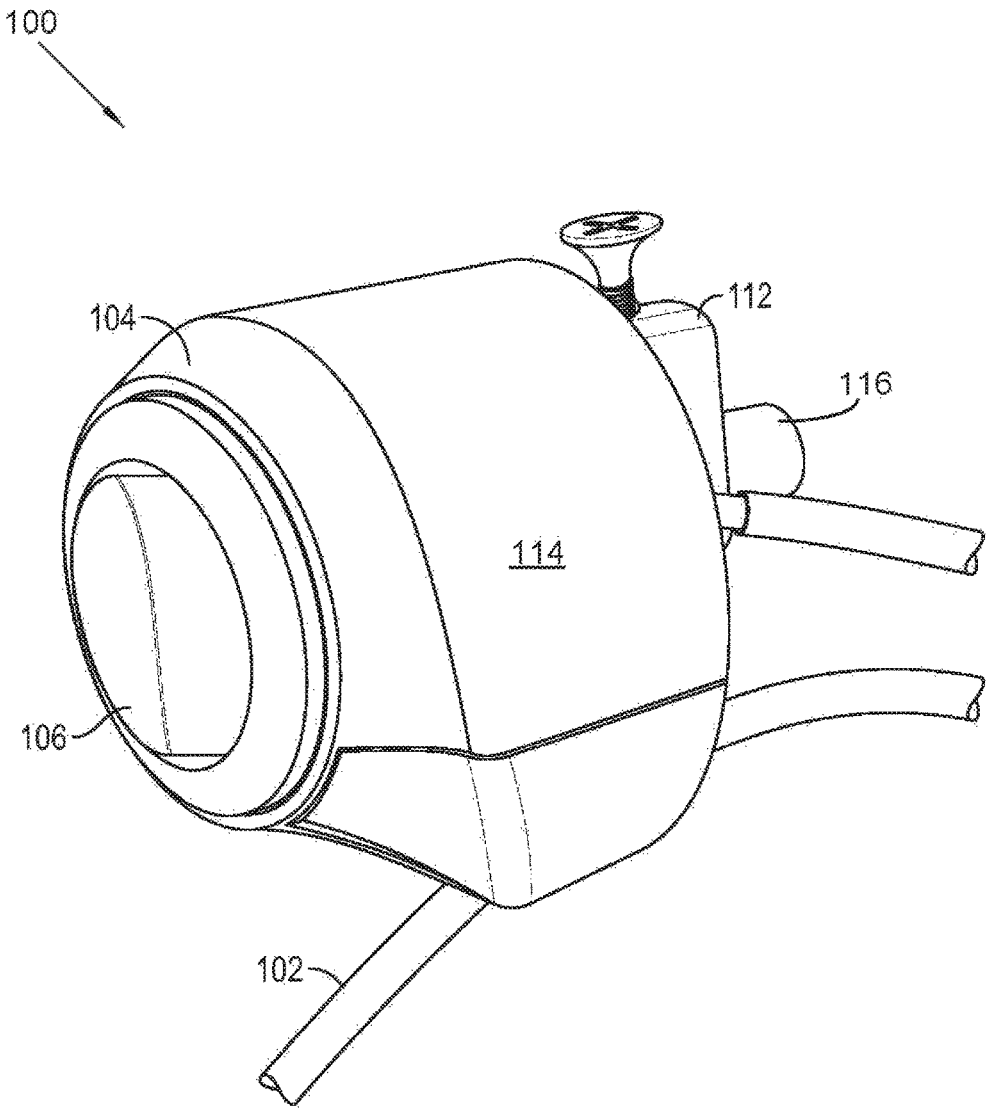
FIG. 4 illustrates a perspective view of an exemplary cap that can be manipulated for applying force to components of the tactile switch, in accordance with an embodiment of the present invention.

As FIG. 4 illustrated, a spring 108 operatively connects to the contact pin 110 and the conductive member 116. The spring 108 is configured to bias the conductive member 116 to a retracted position that disengages the conductive member 116 from the contact pin 110. The force applied to the cap 106 axially displaces the conductive member 116 to an extended position that deforms the spring 108 and enables engagement with the contact pin 110. In one embodiment, the spring 108 is fabricated from music wire 102, and has a diameter of about 0.250"

The spring 108 is carried by a spring axis 118 that maintains the spring 108 in a coaxial disposition with the contact pin 110 and the conductive member 116. The spring axis 118 may include a rod that is sized to receive the spring 108. The conductive member 116 engages the spring 108 so as to compress and expand the spring 108 around the contact pin 110. This compression and expansion of the spring 108 works to enable and disable the flow of direct current between the contact pin 110 and the conductive member 116.

In one embodiment, the force applied to the cap 106 displaces the conductive member 116 to the extended position, which deforms the spring 108 such that the conductive member 116 is displaced to an extended position at least partially outside of the interior region of the spring 108. In this manner, the conductive member 116 is at least partially extended from the interior region of the spring 108, and thereby engaged and conducting direct current to the contact pin 110. From this extended position, the contact pin 110 carries the direct current to the illumination device 200.

In this manner, engagement between the conductive member 116 and the contact pin 110 enables electrical conduction of the direct current from the conductive member 116 to the contact pin 110. Conversely, disengagement between the conductive member 116 and the contact pin 110 disables electrical conduction of the direct current from the conductive member 116 to the contact pin 110. In both scenarios, tactile feedback is obtained at the cap 106.

In some embodiments, the assembly 300 utilizes a second major component to emit an illumination. The tactile switch 100 regulates power and light intensity to the illumination device 200. The illumination device 200 comprises a casing 202 defined by a casing cavity 214. The casing 202 is configured to detachably mate with the switch housing 104 of the tactile switch 100. The mating may be friction fit, magnetic, or through various fasteners. In any case, the tactile switch 100 easily detaches and mates with a second illumination device. The illumination device 200 may include, without limitation, a spotlight, a hand held spotlight, a flashlight, a torch, and a lamp.

A conducting shaft 206 is disposed in the casing cavity 214 of the casing 202. The conducting shaft 206 is configured to detachably mate with the contact pin 110 in conjunction with the detachable mating between the casing 202 and the switch housing 104. Thus, when the switch housing 104 and the casing 202 are mated, the conducting shaft 206 and the contact pin 110 are engaged. The conducting shaft 206, however, receives the direct current from the contact pin 110 only when the conductive member 116 has been displaced to the extended position by applying force to the cap 106.

As discussed above, the illumination device 200 operatively and detachably attaches to the tactile switch 100 through engagement between the conducting shaft 206 and the contact pin 110. The conducting shaft 206 that receives the direct current from the contact pin 110. The conducting shaft 206 is configured to conduct direct current from the contact pin 110 when the conductive member 116 is in the extended position. The conducting shaft 206 conducts the direct current from tactile switch components to components of the illumination device 200.

The illumination device 200 further includes an inverter 210 that is operatively connected to the conducting shaft 206. The inverter 210 works to convert the direct current received from the tactile switch 100 to an alternating current. Those skilled in the art will recognize that direct current is useful when outdoors or receiving current from a battery. The alternating current is, however, more efficient for actuating illumination in the illumination device 200.

The illumination device has a circuitry 212 that converts the alternating current to power a lamp inside the illumination device 200. The lamp can then project a bright beam of light onto a space for desired illumination. Thus, the tactile switch 100 selectively opens and closes the circuit of direct current to operate the illumination device 200 with an alternating current.

In alternative embodiments, the illumination device 200 comprises a detachable handle 208 that helps manipulate the illumination device 200. The handle 208 may also brace the illumination device 200 when manipulating the tactile switch 100. FIG. 1 illustrates the handle 208 as a generally cylindrical member that can be comfortably gripped by the hand.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. An electrical assembly of an interchangeable tactile switch and an illumination device, the assembly comprising:

a wire configured to carry a direct current;

a tactile switch configured to enable selective opening and closing of a circuit, the tactile switch having:

a switch housing defined by a sidewall and a cavity, the switch housing configured to receive the wire;

a conductive member disposed in the cavity of the switch housing, the conductive member configured to conduct the direct current from the wire, the conductive member further configured for axial displacement in the cavity;

a base configured to carry the conductive member in a generally axial disposition;

a cap configured to operatively connect to the conductive member, the cap further configured to receive a force that is transferable to the conductive member, wherein the force axially displaces the conductive member, the cap further configured to provide tactile indication of the axial position of the conductive member relative to the base;

a contact pin operatively connected to the conductive member, the contact pin configured to selectively conduct the direct current;

a spring operatively connected to the contact pin and the conductive member, the spring configured to bias the conductive member to a retracted position that disengages the conductive member from the contact pin, wherein the force applied to the cap axially displaces the conductive member to an extended position that deforms the spring to enable engagement with the contact pin, wherein engagement between the conductive member and the contact pin enables electrical conduction of the direct current from the conductive member to the contact pin, wherein disengagement between the conductive member and the contact pin disables electrical conduction of the direct current from the conductive member to the contact pin;

a spring axis configured to carry the spring in a generally coaxial relationship with the contact pin and the conductive member;

an illumination device configured to emit an illumination, the illumination device having:

a casing defined by a casing cavity, the casing configured to detachably mate with the switch housing of the tactile switch;

a conducting shaft disposed in the casing cavity of the casing, the conducting shaft configured to detachably mate with the contact pin in conjunction with the detachable mating between the casing and the switch housing, the conducting shaft further configured to conduct the direct current from the contact pin;

an inverter operatively connected to the conducting shaft, the inverter configured to convert the direct current to an alternating current; and a circuitry configured to convert the alternating current into illumination.

2. The assembly of claim 1, wherein the direct current is a 12 volt direct current.

3. The assembly of claim 1, wherein the tactile switch carries about 20 amperes of direct current.

4. The assembly of claim 1, wherein the contact pin has a diameter of about 0.250 inches.

5. The assembly of claim 1, wherein the contact pin is fabricated from brass.

6. The assembly of claim 1, wherein the spring has a diameter of about 0.250 inches.

7. The assembly of claim 1, wherein the spring axis maintains the spring in a coaxial relationship with the contact pin, so as to receive the contact pin.

8. The assembly of claim 1, wherein the contact pin forms a snug fit at least partially inside the spring.

9. The assembly of claim 1, wherein the spring is fabricated from music wire.

10. The assembly of claim 1, wherein the switch housing is fabricated from ABS plastic.

11. The assembly of claim 1, wherein the illumination device is a handheld spotlight.

12. The assembly of claim 1, wherein the illumination device further includes a handle, the handle configured to enable manipulation of the illumination device.

13. The assembly of claim 12, wherein the handle is configured to brace the tactile switch for operation.

14. The assembly of claim 1, wherein the cap is a resilient rubber cap.

15. The assembly of claim 14, wherein the resilient rubber cap is configured to cover the conductive member, wherein the resilient rubber cap is further configured to be flexible, wherein the flexible characteristics of the resilient rubber cap enhance the tactile indication of the position of the conductive member relative to the position of the base.

16. An electrical assembly of an interchangeable tactile switch and a spotlight, the assembly comprising:

a wire configured to carry a direct current;

a tactile switch configured to enable selective opening and closing of a circuit, the tactile switch having:

a switch housing defined by a sidewall and a cavity, the switch housing configured to receive the wire;

a conductive member disposed in the cavity of the switch housing, the conductive member configured to conduct the direct current from the wire, the conductive member further configured for axial displacement in the cavity;

a base configured to carry the conductive member in a generally axial disposition;

a cap configured to operatively connect to the conductive member, the cap further configured to receive a force that is transferable to the conductive member, wherein the force axially displaces the conductive member, the cap further configured to provide tactile indication of the axial position of the conductive member relative to the base;

a contact pin operatively connected to the conductive member, the contact pin configured to selectively conduct the direct current;

a spring operatively connected to the contact pin and the conductive member, the spring configured to bias the conductive member to a retracted position that disengages the conductive member from the contact pin, wherein the force applied to the cap axially displaces the conductive member to an extended position that deforms the spring to enable engagement with the contact pin, wherein engagement between the conductive member and the contact pin enables electrical conduction of the direct current from the conductive member to the contact pin, wherein disengagement between the conductive member and the contact pin disables electrical conduction of the direct current from the conductive member to the contact pin;

a spring axis configured to carry the spring in a generally coaxial relationship with the contact pin and the conductive member;

a spotlight configured to emit an illumination, the spotlight having:

a casing defined by a casing cavity, the casing configured to detachably mate with the switch housing of the tactile switch;

a conducting shaft disposed in the casing cavity of the casing, the conducting shaft configured to detachably mate with the contact pin in conjunction with the detachable mating between the casing and the switch housing, the conducting shaft further configured to conduct the direct current from the contact pin;

an inverter operatively connected to the conducting shaft, the inverter configured to convert the direct current to an alternating current;

a circuitry configured to convert the alternating current into illumination; and a handle configured to enable manipulation of the illumination device and brace the tactile switch for operation.

17. The assembly of claim 16, wherein the tactile switch carries about 20 amperes of direct current.

18. The assembly of claim 16, wherein the contact pin has a diameter of about 0.250 inches.

19. The assembly of claim 16, wherein the contact pin is fabricated from brass.

20. The assembly of claim 16, wherein the spring has a diameter of about 0.250 inches.

* * * * *